US011437004B2

(12) United States Patent
Duthaler

(10) Patent No.: US 11,437,004 B2
(45) Date of Patent: Sep. 6, 2022

(54) AUDIO PERFORMANCE WITH FAR FIELD MICROPHONE

(71) Applicant: Bose Corporation, Framingham, MA (US)

(72) Inventor: Gregg Michael Duthaler, Needham, MA (US)

(73) Assignee: Bose Corporation, Framingham, MA (US)

( * ) Notice: Subject to any disclaimer, the term of this patent is extended or adjusted under 35 U.S.C. 154(b) by 670 days.

(21) Appl. No.: 16/446,987

(22) Filed: Jun. 20, 2019

(65) Prior Publication Data

US 2020/0402490 A1 Dec. 24, 2020

(51) Int. Cl.

| | |
|---|---|
| ***G10H 1/36*** | (2006.01) |
| ***G10H 1/00*** | (2006.01) |
| ***H04R 3/00*** | (2006.01) |
| ***G10L 21/0208*** | (2013.01) |

(52) U.S. Cl.

CPC ..... *G10H 1/368* (2013.01); *G10H 1/0008* (2013.01); *G10L 21/0208* (2013.01); *H04R 3/005* (2013.01)

(58) Field of Classification Search

None

See application file for complete search history.

(56) References Cited

U.S. PATENT DOCUMENTS 5,563,358 A * 10/1996 Zimmerman ..... G10H 1/44 84/454
8,098,831 B2 * 1/2012 Rubio ..... G10H 1/361 381/124
2008/0299530 A1 * 12/2008 Veitch ..... G10H 1/368 434/307 A
2009/0165634 A1 * 7/2009 Mahowald ..... G10H 1/368 84/610
2011/0003638 A1 * 1/2011 Lee ..... G10H 1/368 463/43
2013/0317783 A1 * 11/2013 Tennant ..... G10L 21/0208 702/191
2015/0180536 A1 * 6/2015 Zhang ..... H04M 1/6041 381/66

(Continued)

OTHER PUBLICATIONS

Screen shot of Youtube video showing adaption of Amazon Alexa with karaoke, available at: https://www.youtube.com/watch?v=4r7TOrgSL3c.

*Primary Examiner* — Hemant S Patel

(74) *Attorney, Agent, or Firm* — Hoffman Warnick LLC

(57) ABSTRACT

Various aspects include systems and approaches for providing audio performance capabilities with one or more far field microphones. One aspect includes a method of controlling a speaker system with at least one far field microphone that is coupled with a separate display device. The method can include: receiving a user command to initiate an audio performance mode; initiating audio playback of an audio performance file at a transducer at the speaker system; initiating video playback including musical performance guidance associated with the audio performance file at the display device; receiving a user generated acoustic signal at the at least one far field microphone after initiating the audio playback and the video playback; comparing the user generated acoustic signal with a reference acoustic signal; and providing feedback about the comparison to the user.

16 Claims, 4 Drawing Sheets

(56) References Cited

U.S. PATENT DOCUMENTS

2016/0150337 A1* 5/2016 Nandy ..... G10L 21/0208
381/66
2017/0193843 A1* 7/2017 Goncalves ..... G09B 15/023

* cited by examiner

AUDIO PERFORMANCE WITH FAR FIELD MICROPHONE

TECHNICAL FIELD

This disclosure generally relates to audio performance functions in speaker systems and related devices. More particularly, the disclosure relates to systems and approaches for providing audio performance capabilities using a far field microphone.

BACKGROUND

The proliferation of speaker systems and audio devices in the home and other environments has enabled dynamic user experiences. However, many of these user experiences are limited by use of smaller, portable video systems such as those found on smart devices, making such experiences less than immersive.

SUMMARY

All examples and features mentioned below can be combined in any technically possible way.

Various aspects include systems and approaches for providing audio performance capabilities with one or more far field microphones. In certain aspects, a system with at least one far field microphone is configured to enable an audio performance. In certain other aspects, a computer-implemented method enables a user to conduct an audio performance with at least one far field microphone.

In some particular aspects, a speaker system includes: an acoustic transducer; a set of microphones including at least one far field microphone; a communications module for communicating with a display device that is distinct from the speaker system; and a control system coupled with the acoustic transducer, the set of microphones and the communications module, the control system configured to: receive a user command to initiate an audio performance mode; initiate audio playback of an audio performance file at the transducer; initiate video playback including musical performance guidance associated with the audio performance file at the display device; receive a user generated acoustic signal at the at least one far field microphone after initiating the audio playback and the video playback; compare the user generated acoustic signal with a reference acoustic signal; and provide feedback about the comparison to the user.

In some particular aspects, a computer-implemented method of controlling a speaker system is disclosed. The speaker system includes at least one far field microphone and is coupled with a display device that is distinct from the speaker system. In these aspects, the method includes: receiving a user command to initiate an audio performance mode; initiating audio playback of an audio performance file at a transducer at the speaker system; initiating video playback including musical performance guidance associated with the audio performance file at the display device; receiving a user generated acoustic signal at the at least one far field microphone after initiating the audio playback and the video playback; comparing the user generated acoustic signal with a reference acoustic signal; and providing feedback about the comparison to the user.

Implementations may include one of the following features, or any combination thereof.

In certain implementations the display device includes a video monitor.

In some aspects, the control system is further configured to connect with a geographically separated speaker system, and via a corresponding control system at the geographically separated speaker system: initiate audio playback of the audio performance file at a transducer at the geographically separated speaker system; initiate video playback of the musical performance guidance at a display device proximate the geographically separated speaker system; and receive a user generated acoustic signal from a user proximate the geographically separated speaker system.

In particular cases, the control system is further configured to compare the user generated acoustic signal with the user generated acoustic signal from the user proximate the geographically separated speaker system, and provide comparative feedback to both of the users.

In some implementations, the control system is further configured to: record the received user generated acoustic signal in a file; and provide the file for mixing with subsequently received acoustic signals or another audio file at the speaker system or a geographically separated speaker system.

In certain aspects, the control system is further configured to score a mixed file that includes a mix of the subsequently received acoustic signals or another audio file with the file including the received user generated acoustic signal, against a reference mixed audio file.

In particular cases, the control system is connected with a wearable audio device, and the control system is further configured to send the received user generated acoustic signal to the wearable audio device for feedback to the user in less than approximately 50 milliseconds after receipt.

In some implementations, the musical performance guidance includes sheet music for an instrument, adapted sheet music for the instrument, or voice-related musical descriptive language for a vocal performance.

In certain aspects, the control system is further configured to record the user generated acoustic signal with the audio playback of the audio performance file for subsequent playback.

In particular implementations, the speaker system includes a soundbar and is directly physically coupled with the display device. In other particular implementations, the speaker system includes a soundbar and is wirelessly coupled with the display device.

In some cases, the control system includes a computational component and a scoring engine coupled with the computational component, where comparing the user generated acoustic signal with the reference acoustic signal includes: processing the user generated acoustic signal at the computational component; generating a pitch value for the processed user generated acoustic signal; and determining whether the generated pitch value deviates from a stored pitch value for the reference acoustic signal.

In particular aspects, the at least one far-field microphone is configured to pick up audio from locations that are at least one meter (or, a few feet) from the at least one far-field microphone.

In certain implementations, the display device includes a display screen having a corner-to-corner dimension greater than approximately 50 centimeters (cm), 75 cm, 100 cm, 125 cm or 150 cm.

Two or more features described in this disclosure, including those described in this summary section, may be combined to form implementations not specifically described herein.

The details of one or more implementations are set forth in the accompanying drawings and the description below.

Other features, objects and advantages will be apparent from the description and drawings, and from the claims.

Figure 1:
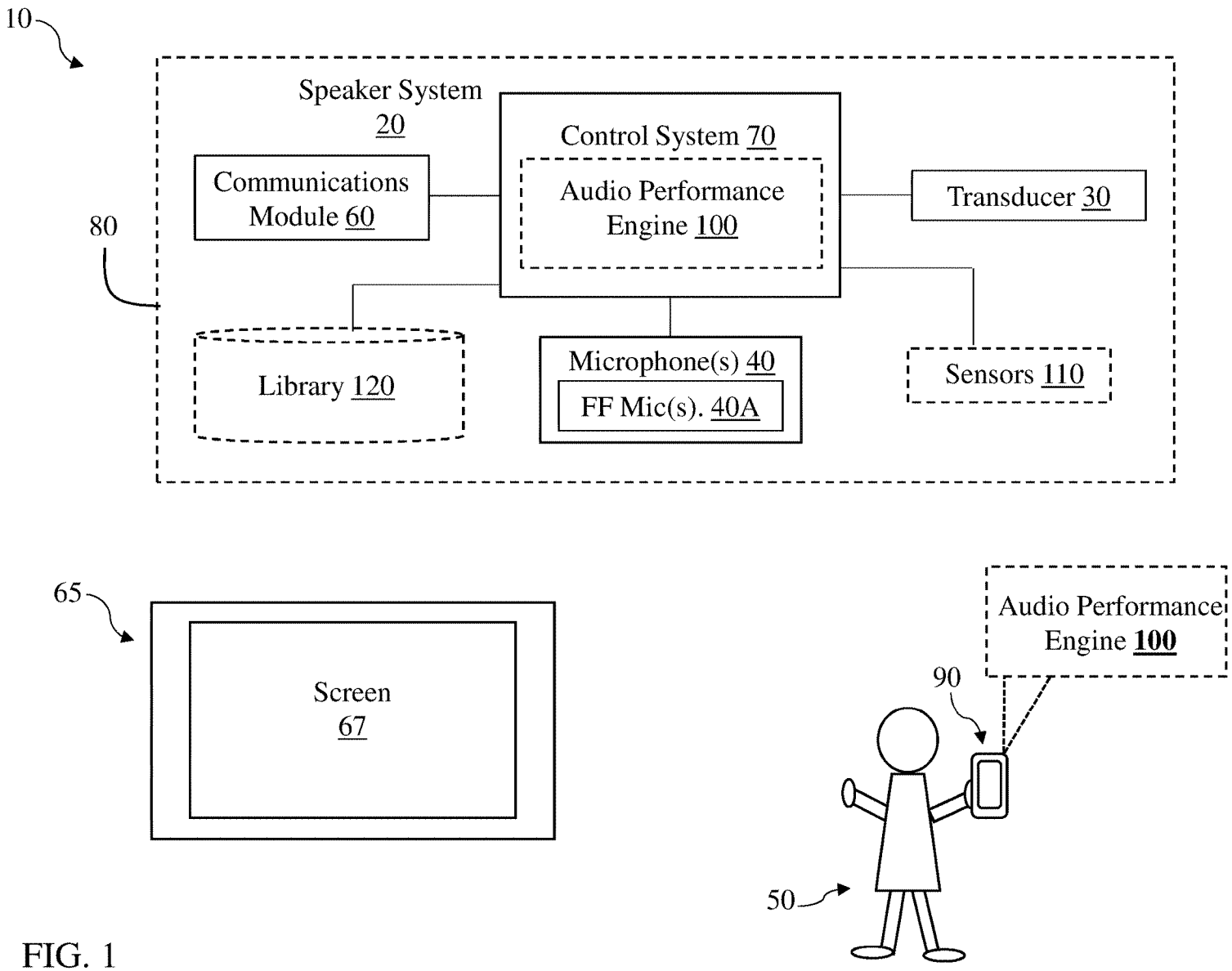
FIG. 1 is a schematic depiction of an environment illustrating an audio performance engine according to various implementations.

It is noted that the drawings of the various implementations are not necessarily to scale. The drawings are intended to depict only typical aspects of the disclosure, and therefore should not be considered as limiting the scope of the invention. In the drawings, like numbering represents like elements between the drawings.

DETAILED DESCRIPTION

As noted herein, various aspects of the disclosure generally relate to speaker systems and related control methods. More particularly, aspects of the disclosure relate to controlling audio performance experiences for users of a speaker system, such as an at-home speaker system.

Commonly labeled components in the FIGURES are considered to be substantially equivalent components for the purposes of illustration, and redundant discussion of those components is omitted for clarity.

Aspects and implementations disclosed herein may be applicable to a wide variety of speaker systems, e.g., a stationary or portable speaker system. In some implementations, a speaker system (e.g., a stationary speaker system such as a home audio system, soundbar, automobile audio system, or audio conferencing system, or a portable speaker system such as a smart speaker or hand-held speaker system) is disclosed. Certain examples of speaker systems are described as "at-home" speaker systems, which is to say, these speaker systems are designed for use in a predominately stationary position. While that stationary position could be in a home setting, it is understood that these stationary speaker systems could be used in an office, a retail location, an entertainment venue, a restaurant, an automobile, etc. In some cases, the speaker system includes a hard-wired power connection. In additional cases, the speaker system can also function using battery power. It should be noted that although specific implementations of speaker systems primarily serving the purpose of acoustically outputting audio are presented with some degree of detail, such presentations of specific implementations are intended to facilitate understanding through provision of examples and should not be taken as limiting either the scope of disclosure or the scope of claim coverage.

In all cases described herein, the speaker system includes a set of microphones that includes at least one far field microphone. In various particular implementations, the speaker system includes a set of microphones that includes a plurality of far field microphones. That is, the far field microphone(s) are configured to detect and process acoustic signals, in particular, human voice signals, at a distance of at least one meter (or one to two wavelengths) from the user.

Various particular implementations include speaker systems and related computer-implemented methods of controlling audio performances. In various implementations, a speaker system (including at least one far field microphone) is configured to initiate an audio performance mode, including audio playback of an audio performance file at its transducer and video playback of musical performance guidance at a distinct display device. The system is further configured to receive a user generated acoustic signal at the far field microphone and compare that received user generated signal with a reference signal to provide feedback to the user. In some cases, the speaker system can enable karaoke-style audio performances. In still other cases, the speaker system can enable audio performance comparison and/or feedback from a plurality of users, located in the same or geographically distinct locations. In additional cases, the speaker system can enable recording of user generated acoustic signals and mixing and/or editing of the recording (s). In further cases, the speaker system enables low-latency feedback using a wearable audio device. In some additional cases, the speaker system enables musical performance guidance, e.g., for an instrument and/or a vocal performance. In any case, the speaker system enables a dynamic, immersive audio performance experience for users that is not available in conventional systems.

FIG. 1 shows an illustrative physical environment 10 including a speaker system 20 according to various implementations. As shown, the speaker system 20 can include an acoustic transducer 30 for providing an acoustic output to the environment 10. It is understood that the transducer 30 can include one or more conventional transducers, such as a low frequency (LF) driver (or, woofer) and/or a high frequency (HF) driver (or, tweeter) for audio playback to the environment 10. The speaker system 20 can also include a set of microphones 40. In some implementations, the microphone(s) 40 includes a microphone array including a plurality of microphones. In all cases, the microphone(s) 40 include at least one far field (FF) microphone (mic) 40A. The microphones 40 are configured to receive acoustic signals from the environment 10, such as voice signals from one or more users (one example user 50 shown) or an acoustic or non-acoustic output from one or more musical instruments. An example of a non-acoustic output from one or more musical instruments can include, e.g., a signal generated in a device having one or more inputs that correspond to non-emitted acoustic outputs. The microphone(s) 40 can also be configured to detect ambient acoustic signals within a detectable range of the speaker system 20.

The speaker system 20 can further include a communications module 60 for communicating with one or more other devices in the environment 10 and/or in a network (e.g., a wireless network). In some cases, the communications module 60 can include a wireless transceiver for communicating with other devices in the environment 10. In other cases, the communications module 60 can communicate with other devices using any conventional hard-wired connection and/or additional communications protocols. In some cases, communications protocol(s) can include a Wi-Fi protocol using a wireless local area network (WLAN), a communication protocol such as IEEE 802.11 b/g or 802.11 ac, a cellular network-based protocol (e.g., third, fourth or fifth generation (3G, 4G, 5G cellular networks) or one of a plurality of internet-of-things (IoT) protocols, such as: Bluetooth, BLE Bluetooth, ZigBee (mesh LAN), Z-wave (sub-GHz mesh network), 6LoWPAN (a lightweight IP protocol), LTE protocols, RFID, ultrasonic audio protocols, etc. In additional cases, the communications module 60 can enable the speaker system 20 to communicate with a remote server, such as a cloud-based server running an application for managing audio performances. In various particular implementations, separately housed components in speaker system 20 are configured to communicate using one or more conventional wireless transceivers.

In certain implementations, the communications module 60 is configured to communicate with a display device 65 that is distinct from the speaker system 20. In particular cases, the display device 65 is a physically distinct device from the speaker system 20 (e.g., in separate housings). In these cases, the display device 65 can be connected with the communications module 60 in any manner described herein. According to particular examples, the speaker system 20 includes a soundbar, and is directly physically coupled with the display device 65, e.g., via a hard-wired connection such as a High-Definition Multimedia Interface (HDMI) connection. In still other examples, the speaker system 20 (e.g., soundbar) can be connected with the display device 65 over one or more wireless connections described herein. In a particular example, the speaker system 20 and display device 65 are connected by wireless HDMI.

The display device 65 can include a video monitor, including a display screen 67 for displaying video content according to various implementations. In some cases, the display device 65 includes a display screen 67 having a corner-to-corner dimension greater than approximately 50 centimeters (cm), 75 cm, 100 cm, 125 cm or 150 cm. That is, the display screen 67 can be sized such that its intended viewing distance (or setback) is approximately 1 meter (or, approximately 3 feet) or greater. In some cases, the display device 65 is significantly larger than 50 cm from corner-to-corner, and has an intended viewing distance that is approximately one meter or more (e.g., one to two wavelengths from the source).

The speaker system 20 can further include a control system 70 coupled with the transducer 30, the microphone(s) 40 and the communications module 60. As described herein, the control system 70 can be programmed to control one or more audio performance characteristics. The control system 70 can include conventional hardware and/or software components for executing program instructions or code according to processes described herein. For example, control system 70 can include one or more processors, memory, communications pathways between components, and/or one or more logic engines for executing program code. In certain examples, the control system 70 includes a microcontroller or processor having a digital signal processor (DSP), such that acoustic signals from the microphone(s) 40, including the far field microphone(s) 40A, are converted to digital format by analog to digital converters.

Control system 70 can be coupled with the transducer 30, microphone 40 and/or communications module 60 via any conventional wireless and/or hardwired connection which allows control system 70 to send/receive signals to/from those components and control operation thereof. In various implementations, control system 70, transducer 30, microphone 40 and communications module 60 are collectively housed in a speaker housing 80 (shown optionally in phantom). However, as described herein, control system 70, transducer 30, microphone 40 and/or communications module 60 may be separately housed in a speaker system (e.g., speaker system 20) that is connected by any communications protocol (e.g., a wireless communications protocol described herein) and/or via a hard-wired connection.

For example, in some implementations, functions of the control system 70 can be managed using a smart device 90 that is connected with the speaker system 20 (e.g., via any wireless or hard-wired communications mechanism described herein, including but not limited to Internet-of-Things (IoT) devices and connections). In some cases, the smart device 90 can include hardware and/or software for executing functions of the control system 70 to manage audio performance experiences. In particular cases, the smart device 90 includes a smart phone, tablet computer, smart glasses, smart watch or other wearable smart device, portable computing device, etc., and has an audio gateway, processing components, and one or more wireless transceivers for communicating with other devices in the environment 10. For example, the wireless transceiver(s) can be used to communicate with the speaker system 20, as well as one or more connected smart devices within communications range. The wireless transceivers can also be used to communicate with a server hosting a mobile application that is running on the smart device 90, for example, an audio performance engine 100.

The server can include a cloud-based server, a local server or any combination of local and distributed computing components capable of executing functions described herein. In various particular implementations, the server is a cloud-based server configured to host the audio performance engine 100, e.g., running on the smart device 90. According to some implementations, the audio performance engine 100 can be downloaded to the user's smart device 90 in order to enable functions described herein.

In various implementations, sensors 110 located at the speaker system 20 and/or the smart device 90 can be used for gathering data prior to, during, or after the audio performance mode has completed. For example, the sensors 110 can include a vision system (e.g., an optical tracking system or a camera) for obtaining data to identify the user 50 or another user in the environment 10. The vision system can also be used to detect motion proximate the speaker system 20. In other cases, the microphone 40 (which may be included in the sensors 110) can detect ambient noise proximate the speaker system 20 (e.g., an ambient SPL), in the form of acoustic signals. The microphone 40 can also detect acoustic signals indicating an acoustic signature of audio playback at the transducer 30, and/or voice commands from the user 50. In some cases, one or more processing components (e.g., central processing unit(s), digital signal processor(s), etc.), at the speaker system 20 and/or smart device 90 can process data from the sensors 110 to provide indicators of user characteristics and/or environmental characteristics to the audio performance engine 100. Additionally, in various implementations, the audio performance engine 100 includes logic for processing data about one or more signals from the sensors 110, as well as user inputs to the speaker system 20 and/or smart device 90. In some cases, the logic is configured to provide feedback (e.g., a score or other comparison data) about user generated acoustic signals relative to reference acoustic signal(s).

In certain cases, the audio performance engine 100 is connected with a library 120 (e.g., a local data library or a remote library accessible via any connection mechanism herein), that includes reference acoustic signal data for use in comparing, scoring and/or providing feedback relative to a user's audio performance. The library 120 can also store (or otherwise make accessible) recorded user generated acoustic signals (e.g., in one or more files), or other audio files for use in mixing with the user generated acoustic signals. It is understood that library 120 can be a local library in a common geographic location as one or more portions of control system 70, or may be a remote library stored at least partially in a distinct location or in a cloud-based server. Library 120 can include a conventional storage device such as a memory, distributed storage device and/or cloud-based storage device as described herein. It is further understood that library 120 can include data defining a plurality of reference acoustic signals, including values/ranges for a plurality of audio performance experiences from distinct users, profiles and/or environments. In this sense, library 120 can store audio performance data that is applicable to specific users 50, profiles or environments, but may also store audio performance data that can be used by distinct users 50, profiles or at other environments, e.g., where a set of audio performance settings is common or popular among multiple users 50, profiles and/or environments. In various implementations, library 120 can include a relational database including relationships between detected acoustic signals from one or more users and reference acoustic signals. In some cases, library 120 can also include a text index for acoustic sources, e.g., with preset or user-definable categories. The control system 70 can further include a learning engine (e.g., a machine learning/artificial intelligence component such as an artificial neural network) configured to learn about the received user generated acoustic signals, e.g., from a group of users' performances, either in the environment 10 or in one or more additional environments. In some of these cases, the logic in the audio performance engine 100 can be configured to provide updated feedback about a given audio performance that is performed a number of times, or provide updated feedback about a set of audio performances that have common characteristics. For example, when a user 50 repeats an audio performance (e.g., sings his/her favorite song multiple times), the audio performance engine 100 can be configured to provide distinct feedback about each performance, e.g., in order to refine the user's performance to more closely match the reference performance. In additional cases, the audio performance engine 100 can provide feedback to the user 50 about his/her performance trends. For example, where the user 50 consistently sings off-pitch in distinct performances (e.g., singing distinct songs), the audio performance engine 100 can notify the user of his/her deviation from the reference performance(s) (e.g., indicating that the user 50 sings off pitch in particular types of performances or across all performances, and suggesting corrective action).

As noted herein, the audio performance engine 100 can be configured to initiate an audio performance mode using the speaker system 20 and the connected display device 65 in response to receiving a user command or other input. Particular processes performed by the audio performance engine 100 (and the logic therein) are further described with reference to the flow diagram 200 in FIG. 2, and the additional environment 300 shown schematically in FIG. 3.

Figure 2:
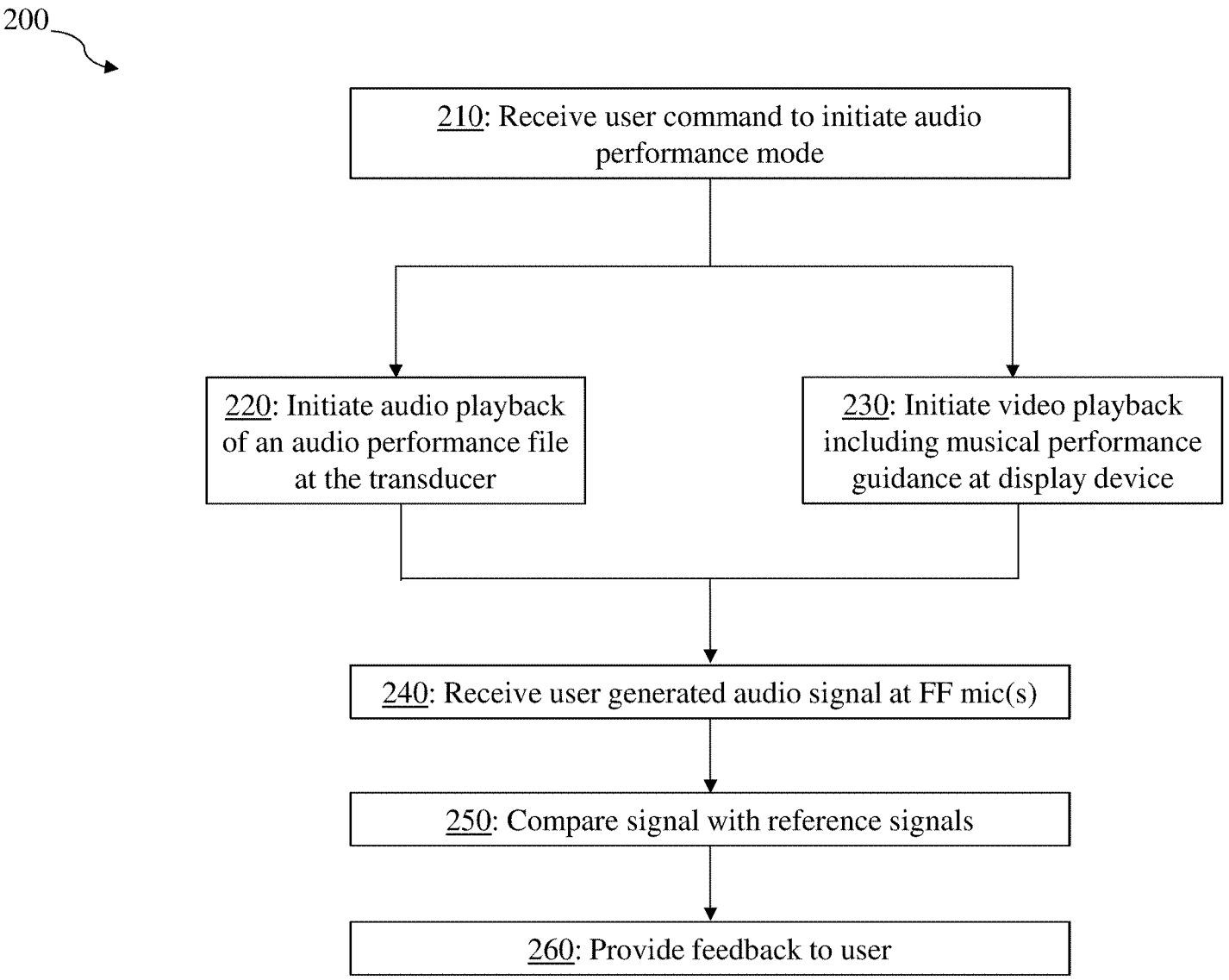
FIG. 2 is a flow diagram illustrating processes in managing audio performances according to various implementations.

As shown in process 210 in FIG. 2, the audio performance engine 100 can be configured to receive a user command (or other input) to initiate an audio performance mode. In some cases, the user command is received via a user interface command. For example, the audio performance engine 100 can present (e.g., render) a user interface at the speaker system 20 (FIG. 1), e.g., on a display or other screen physically located on the speaker system 20. In particular cases, the user interface can be a temporary display on a physical display located at the speaker system 20, e.g., on a top or a side of the speaker housing. In other cases, the user interface is a permanent interface having physically actuatable buttons for adjusting inputs and controlling other aspects of the audio performance(s). In additional cases, a user interface is presented on the display device 65, e.g., on the display screen 67. In other cases, the audio performance engine 100 presents (e.g., renders) a user interface at the smart device 90 (FIG. 1), such as on a display or other screen on that smart device 90. A user interface can be initiated at the smart device 90 as a software application (or, "app") that is opened or otherwise initiated through a command interface.

Command interfaces on the speaker system 20 display device 65 and/or smart device 90 can include haptic interfaces (e.g., touch screens, buttons, etc.), gesture-based interfaces (e.g., relying upon detected motion from an inertial measurement unit (IMU) and/or gyroscope/accelerometer/magnetometer), biosensory inputs (e.g., fingerprint or retina scanners) and/or a voice interface (e.g., a virtual personal assistant (VPA) interface). In still other implementations, the user command can be received and/or processed via a voice interface, such as with a voice command from the user 50 (e.g., "Assistant, please initiate audio performance mode", "Please start karaoke mode", or "Please start instrument learning mode"). In these cases, the user 50 can provide a voice command that is detected either at the microphone(s) 40 at the speaker system 20 and/or at a microphone on the smart device 90. In any case, the user command can include a command to initiate the audio performance mode. Example audio performance modes can include karaoke-style singing performances, musical accompaniment performances (e.g., playing an instrument or singing as an accompaniment to a track), musical instructive performances (e.g., playing an instrument or singing according to instructional material), vocal performances (e.g., acting lessons, public speaking training, impersonation training, comedic performance training), etc.

Figure 3:
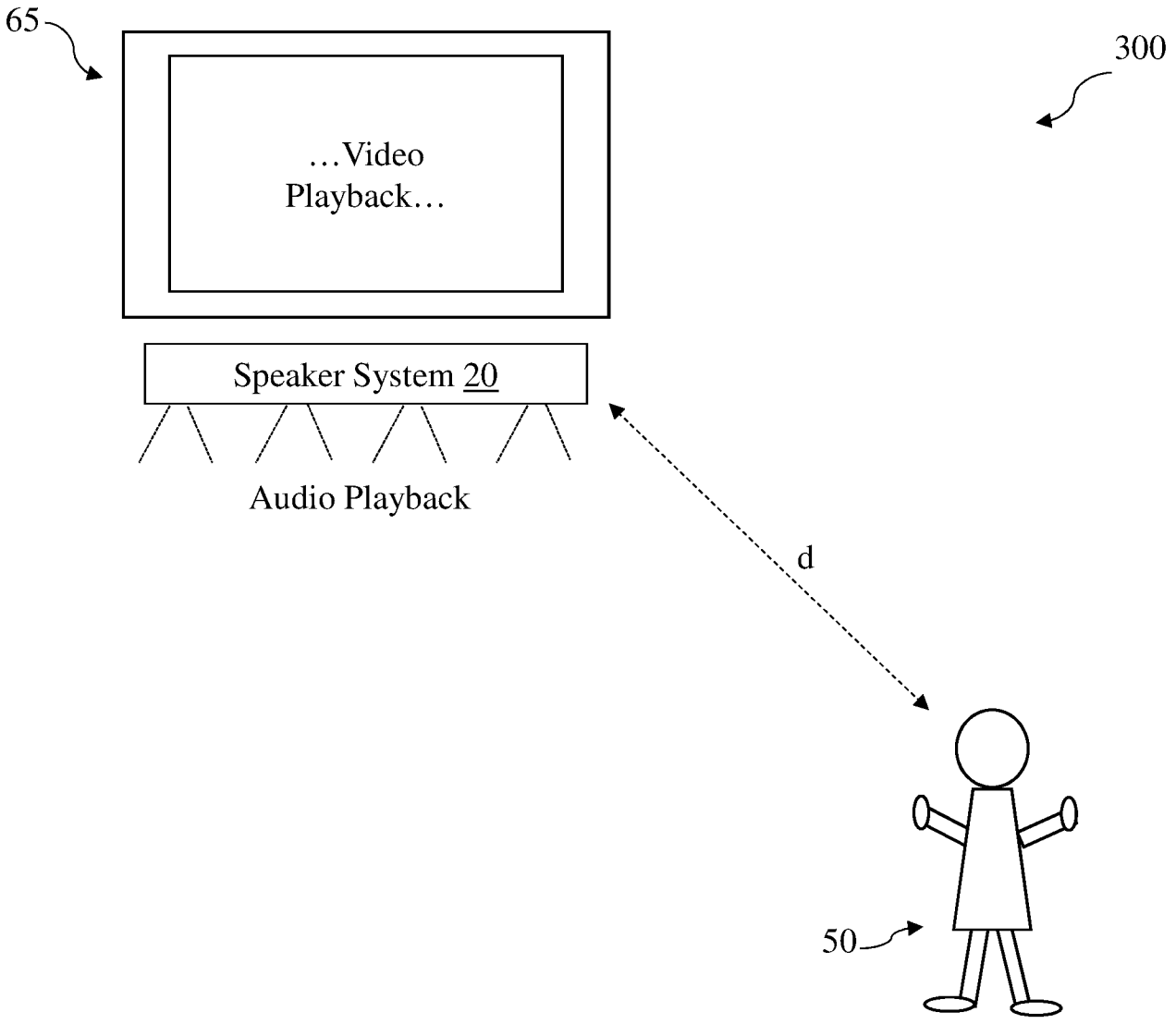
FIG. 3 depicts an example environment illustrating a speaker system, a display device and a user according to various implementations.

As shown in FIG. 2, in process 220, the audio performance engine 100 is configured to initiate audio playback of an audio performance file at the transducer 30 located at the speaker system 20 (FIG. 1). This process is schematically illustrated in the additional depiction of environment 300 in FIG. 3. With reference to FIGS. 1-3, in these cases, the audio performance engine 100 can trigger playback of a file such as a karaoke audio version of a song (e.g., a background track), an audio track that includes playback of tones or other triggers to indicate progression through a song, or another audio playback reference (e.g., playback of portions of a speech, comedy routine, skit or spoken word performance).

As shown in FIG. 2, in what can be a substantially simultaneous process (e.g., within seconds of one another) 230, the audio performance engine 100 is also configured to initiate video playback at the display device 65, including musical performance guidance. This is further illustrated in the environment 300 in FIG. 3. The video playback of the musical performance guidance can include one or more of: a) sheet music for an instrument, b) adapted sheet music for an instrument, or c) voice-related musical descriptive language for a vocal performance. In certain implementations, such as where the audio performance mode includes musical accompaniment or musical instruction, the video playback can include sheet music for the user's instrument. This sheet music can include traditional sheet music using symbols to indicate pitches, rhythms and/or chords of a song or instrumental musical piece. In other cases, the musical performance guidance can include adapted sheet music such as a rolling bar or set of bars indicating which note(s) the user 50 should play/sing at a given time. In some cases, the musical performance guidance can include a mix of traditional sheet music and adapted sheet music, in any notation, such as where both forms of sheet music are presented simultaneously to aid in the user's development of musical reading skills. In still other cases, sheet music (of both traditional and adapted form) can be presented for multiple instruments, and may be presented with corresponding lyrics for the audio performance. In additional cases, the video playback of the musical performance guidance includes voice-related musical descriptive language for a vocal performance. In some cases, this video playback can include lyrics corresponding with the song (or spoken word program) that is played as part of the audio playback. In additional cases, this video playback can include graphics, images, or other creative content relevant to the audio playback, such as artwork from the musicians performing the song, facts about the song playing as part of the audio playback.

After initiating both the audio playback at the transducer 30 and the video playback at the display device 65, in process 240 (FIG. 2), the audio performance engine 100 is configured to receive user generated acoustic signals, via the far field microphone(s) 40A (FIG. 1). That is, the far field microphone(s) 40A are configured to detect (pick up) the user generated acoustic signals within a detectable distance (d) (FIG. 3). In particular cases, the far-field microphone 40A is configured to pick up audio from locations that are approximately two (2) wavelengths away from the source (e.g., the user). For example, the far-field microphone 40A can be configured to pick up audio from locations that are at least one, two or three meters (or, a few feet up to several feet or more) away (e.g., where distance (d) is equal to or greater than one meter). This is in contrast to a conventional hand-held or user-worn microphone, or microphones present on a conventional smart device (e.g., similar to smart device 90). In various implementations, the digital signal processor(s) are configured to convert the far field microphone signals received at the microphone(s) 40A to allow the audio performance engine 100 to compare those signals relative to reference acoustic signals (e.g., in the library 120). In various implementations, the digital signal processor(s) are configured to use automatic echo cancellation (AEC) and/or beamforming in order to process the far field microphone signals. As noted herein, user generated acoustic signals can include voice pickup of the user 50 singing a song (e.g., a karaoke-style performance) and/or pickup of an instrument being played by the user 50 (e.g., in a musical performance and/or instructional scenario).

Returning to FIG. 2, in process 250, after detecting the user generated acoustic signals, the audio performance engine 100 is configured to compare those signals with reference acoustic signals and provide feedback (e.g., to the user 50). In some cases, the audio performance engine 100 compares the detected user generated acoustic signals with reference acoustic signals such as those stored in or otherwise accessible via the library 120. In some cases, the reference acoustic signals include pitch values for the audio performance, e.g., an expected range of pitch for one or more portions of the audio portion of the performance, and allows for comparison with the received user generated acoustic signals. In various implementations, one or more DSPs is configured to use AEC and/or beamforming to select acoustic signals that best represent the user performance, and compare those signals against reference signals from the library 120 (e.g., via differential comparison). In particular cases, the control system 70 includes a computational component and a scoring engine coupled with that computational component in order to compare the user generated acoustic signals with the reference acoustic signals. In these cases, the control system 70 is configured to compare the user generated acoustic signals with the reference acoustic signals by:

A) Processing the user generated acoustic signal at the computational component. This process can be performed using a DSP as described herein, e.g., by converting from analog to digital format.

B) Generating a pitch value for the processed user generated acoustic signal. In various implementations, the pitch value is generated using the detected frequency of the user generated acoustic signal after it is converted to digital format. Pitch values can be generated for any number of segments of the user generated acoustic signal, e.g., in fractions of a second up to several-second segments for use in comparing the user's performance with a reference.

C) Determining whether the generated pitch value deviates from a stored pitch value for the reference acoustic signal. In some cases, the reference acoustic signal is a specific frequency for a segment of the audio playback, or includes a frequency range for each segment of the audio playback that falls within a desired range. This reference acoustic signal defines a desired acoustic signal (or signal range) received at a microphone separated by the far field distance (d) defined herein. In the case of a musical performance, the reference acoustic signal can be defined by the musical notation of the piece of music (e.g., by instrument, or vocals), or can be defined by a practical standard such as the performance of a piece of music by an artist (e.g., the original artist performing a song). In these cases, the reference acoustic signal can be derived from a digital representation of the musical notation, or by converting the artist's performance (in digital form) into sets of frequency values and/or ranges. As described herein, the audio performance engine 100 can be configured to perform a differential comparison between one or more values for the user-generated acoustic signals with the reference acoustic signals, e.g., determining a difference in the generated pitch value for the user's performance and a stored pitch value for the reference signal.

Based upon the comparison with the reference acoustic signal, the audio performance engine 100 is configured to provide feedback to the user (process 260, FIG. 2). In some cases, that feedback can include a score or other feedback against the reference acoustic signal (e.g., "You scored a 92% accuracy against the original artist", or "You received a B− for accuracy"), and/or sub-scores for particular segments of the performance (e.g., "You sang the chorus perfectly, but went off-pitch in the second verse"). In other cases, the feedback can include a timeline-style graphical depiction of the comparison with the reference, or audio playback of portions of the performance that were close to the reference and/or deviated significantly from the reference. The feedback can be provided to the user 50 in any communications mechanism described herein, e.g., via text, voice, visual depictions, etc. In some cases, the audio performance engine 100 can provide real-time feedback to the user 50, e.g., via a tactile or visual cues in order to indicate that the user generated acoustic signals are either corresponding with (positive feedback) or deviating from (negative feedback) the reference. The audio performance engine 100 is also configured to store this feedback and/or make it available for multiple users in multiple audio performances and/or sessions, e.g., as a "leaderboard" or other comparative indicator.

In some particular examples, the control system 70 can be connected with a wearable audio device on the user 50, e.g., a set of headphones, earbuds or body-worn speakers, and can be configured to send feedback to the user with minimal latency. In some examples, the control system 70 is configured to send the received user generated acoustic signal to the wearable audio device on the user 50 in less than approximately 100 milliseconds, 80 milliseconds, 60 milliseconds, 50 milliseconds, 40 milliseconds, 30 milliseconds, 20 milliseconds or 10 milliseconds after receipt. In certain examples, the control system 70 is configured to send the received user generated acoustic signal to the wearable audio device on the user 50 in less than approximately (e.g., +/−5%) 50 milliseconds after receipt. In more particular cases, the control system 70 sends the received user generated acoustic signal to the wearable audio device in less than approximately (e.g., +/−5%) 10 milliseconds after receipt. In these cases, the wearable audio device can be hard-wired to the speaker system 20, however, in some examples, the wearable audio device is wirelessly connected with the speaker system 20. In these examples, the low-latency feedback of the received user generated acoustic signal may enable the user to make real-time adjustments to his/her pitch to improve performance.

In some additional examples, the audio performance engine 100 is further configured to record the user generated acoustic signal with the audio playback of the audio performance file for subsequent (later) playback. In these cases, the audio performance engine 100 can initiate recording of the user generated acoustic signal with a time-aligned playback of the audio performance file. That is, the audio performance engine 100 can be configured to synchronize the audio performance file with the recorded user generated acoustic signal in order to create a time-aligned recording of the performance. In various implementations, this process can include time-shifting the audio performance file (e.g., by milliseconds) according to a time delay between the playback of the audio performance file and the received user generated acoustic signal. As noted herein, the user generated acoustic signal(s) can be filtered or otherwise processed (e.g., with AEC and/or beamforming) prior to being synchronized with the audio performance file. Recording can be a default setting for the audio performance mode, or can be selected by the user 50 (e.g., via a user interface command). In some cases, the control system 70 (including the audio performance engine 100) can include microphone array filters and/or other signal processing components to filter out ambient noise during recording. The user 50 can access the recording that includes both the user generated acoustic signal and the playback of the audio performance file. In the example of a karaoke-style audio experience, the recording can include the user's voice signals as detected by the far field microphones 40A (FIG. 1), as well as the playback of the audio performance file (e.g., instrumental track) from the transducer 30, as detected at one or more of the microphones 40 at the speaker system 20. Playback of the recording can provide a representation of the user's voice alongside the instrumental track, e.g., as though recorded in a studio or at a live performance.

In additional implementations, the audio performance engine 100 is configured to record the received user generated acoustic signal in a file, and provide the file for mixing with subsequently received acoustic signals or another audio file at the speaker system 20 or a geographically separated speaker system. In these cases, the file including the user generated acoustic signal can be mixed with additional acoustic signal files, e.g., a subsequent recording of acoustic signals received at the far field microphone(s) 40A. In these examples, the user(s) 50 can record multiple portions of a given track, in distinct signal files, and mix those files together to form a complete track. For example, one or more users 50 can record the voice portion of a track in one file (as user generated acoustic signals detected by the far field mic(s) 40A), and subsequently record an instrumental portion of the same track (or a different track) in another file (as user generated acoustic signals detected by the far field mic(s) 40A), and mix those tracks together using the audio performance engine 100. In various implementations, this track is mixed in a time-aligned manner, according to conventional approaches. This mixed track can be played back at the transducer 30, shared with other users (e.g., via the audio performance engine 100, running on one or more user's devices), and/or stored or otherwise made accessible via the library 120.

In still further cases, the audio performance engine 100 is configured to score a mixed file that includes a mix of the subsequently received acoustic signals, or another audio file, with the file that includes the received user generated acoustic signal, against a reference mixed audio file. In these cases, the reference mixed audio file can include a mix of one or more distinct files (e.g., instrumental recording and separate voice recording for a track) that are compiled into a single file for comparison with the user generated file. One or more portions of the user generated file are recorded using the far field microphones 40A at the speaker system 20, but it is understood that some portions of the mixed file including the user generated acoustic signals can be recorded at a different location, by a different system, or otherwise accessed from a source distinct from the speaker system 20. In various implementations, this file is mixed in a time-aligned manner, according to conventional approaches.

Figure 4:
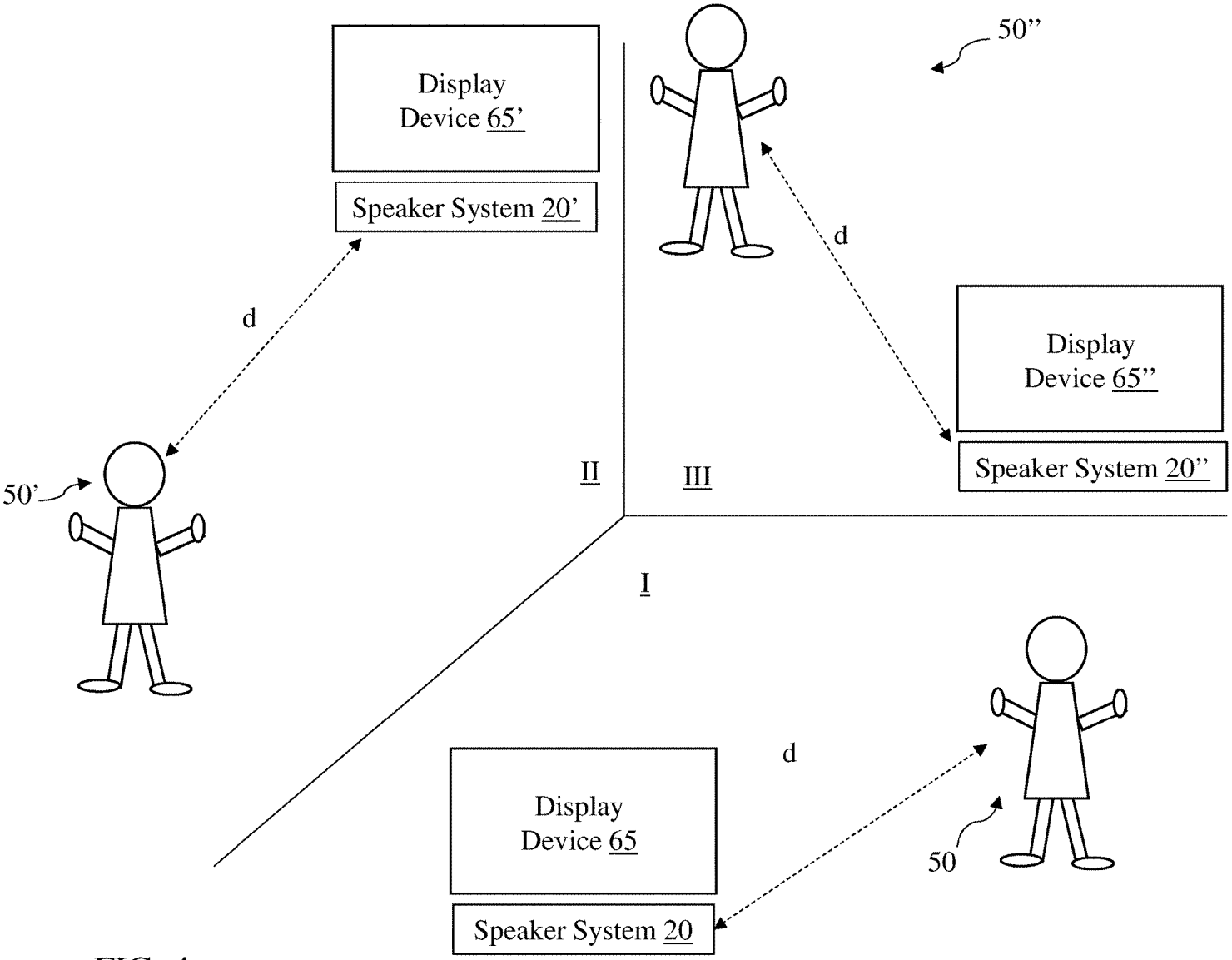
FIG. 4 depicts distinct geographic locations connected by an audio performance engine according to various implementations.

FIG. 4 illustrates an additional implementation where the audio performance engine 100 connects geographically separated speaker systems, such as speaker systems located in different homes, different cities, or different countries. The audio performance engine 100 can enable cloud-based or other (e.g., Internet-based) connectivity between the speaker systems in these distinct geographic locations. FIG. 4 shows three distinct speaker systems 20, 20' and 20" in three distinct geographic locations I, II, and III. Corresponding depictions of users 50 and display devices 65 are also illustrated. In various implementations, the control systems at each speaker system 20 can be connected via the audio performance engine 100 running at the speaker systems 20 and/or at the user's smart devices (e.g., smart device 90, FIG. 1).

In some cases, the audio performance engine 100 enables distinct users 50, at distinct geographic locations (I, II and/or III), to initiate audio playback of an audio performance file at a local transducer at the respective speaker system 20. For example, distinct users 50, 50' can participate in a game using the same audio performance file from distinct locations I, II. One or both users 50, 50' can initiate this game using any interface command described herein. In other cases, the audio performance engine 100 can prompt users to participate in a game based upon profile characteristics, device usage characteristics or other data accessible via the library 120 and/or application(s) running on a smart device (e.g., smart device 90). In various implementations, the audio performance engine 100 is configured to initiate audio playback of the audio performance file at a transducer at each speaker system 20, 20', 20", etc. The audio performance engine 100 is also configured to initiate video playback of the musical performance guidance at the corresponding display devices 65, 65', 65" proximate the geographically separated speaker systems 20, 20', 20". As similarly described herein, the audio performance engine 100 is configured to receive user generated acoustic signals from each of the users 50, 50', 50", as detected by the far field microphones 40A (FIG. 1) at each speaker system 20.

The audio performance engine 100 is also configured to compare the user generated acoustic signals from the users 50, and provide comparative feedback to those users 50. In various implementations, the user generated acoustic signals are compared in a similar manner as the signals received from a single user are compared against the reference acoustic signals, e.g., in terms of pitch in on or more segments of the playback. In various implementations, the audio performance engine 100 can provide a score or other relative feedback to the users 50 to allow each user 50 to compare his/her performance against others. As noted with respect to various implementations herein, time alignment of the user(s) audio signals with other user(s) audio signals, and/or time alignment of those user(s) audio signals with the reference audio signals, can be performed in order to provide scoring or other relevant feedback. This time alignment can be performed according to conventional audio signal processing approaches.

Additional implementations of the speaker system 20 can utilize data inputs from external devices, including, e.g., one or more personal audio devices, smart devices (e.g., smart wearable devices, smart phones), network connected devices (e.g., smart appliances) or other non-human users (e.g., virtual personal assistants, robotic assistant devices). External devices can be equipped with various data gathering mechanisms providing additional information to control system 70 about the environment proximate the speaker system 20. For example, external devices can provide data about the location of one or more users 50 in environment 10, the location of one or more acoustically significant objects in environment (e.g., a couch, or wall), or high versus low trafficked locations. Additionally, external devices can provide identification information about one or more noise sources, such as image data about the make or model of a particular television, dishwasher or espresso maker. Examples of external devices such as beacons or other smart devices are described in U.S. patent application Ser. No. 15/687,961 ("User-Controlled Beam Steering in Microphone Array", filed on Aug. 28, 2017), which is herein incorporated by reference in its entirety.

In various implementations, the speaker system(s) and related approaches for enabling audio performances improve on conventional audio performance systems. For example, the audio performance engine 100 has the technical effect of enabling dynamic and immersive audio performance experiences for one or more users.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

I claim:

1. A system comprising:

a speaker system enabling a multi-user audio performance mode from distinct geographic locations, the speaker system comprising:

an acoustic transducer;

a set of microphones comprising at least one far field microphone;

a communications module for communicating with a display device that is distinct from the speaker system; and a control system coupled with the acoustic transducer, the set of microphones and the communications module, the control system configured to:

receive a user command to initiate an audio performance mode;

initiate audio playback of an audio performance file at the transducer;

initiate video playback comprising musical performance guidance associated with the audio performance file at the display device;

receive a user generated acoustic signal at the at least one far field microphone after initiating the audio playback and the video playback;

compare the user generated acoustic signal with a reference audio signal; and provide feedback about the comparison to the user, wherein the control system is further configured to connect with a geographically separated speaker system, and via a corresponding control system at the geographically separated speaker system:

initiate audio playback of the audio performance file at a transducer at the geographically separated speaker system;

initiate video playback of the musical performance guidance at a display device proximate the geographically separated speaker system;

receive a user generated acoustic signal from an additional user proximate the geographically separated speaker system, compare the user generated acoustic signal with the user generated acoustic signal from the additional user proximate the geographically separated speaker system, wherein comparing the user generated acoustic signals comprises time alignment of each of the user generated acoustic signals with at least one of the other user generated acoustic signals or the reference audio signal, and wherein comparing the user generated acoustic signals includes determining a relative score for each of the user and the additional user based on a pitch in one or more segments of the audio playback, and provide comparative feedback including the relative scores to each of the users.

2. The system of claim 1, wherein the display device comprises a video monitor.

3. The system of claim 1, wherein the control system is further configured to:

record the received user generated acoustic signal in a first file and record the received additional user generated acoustic signal in a second file;

provide the first file and the second file for mixing with subsequently received audio signals or another audio file at the speaker system or the geographically separated speaker system;

comparatively score two mixed files that comprise a mix of the subsequently received audio signals or another audio file with each of the first file and the second file, and score each of the two mixed files against a reference mixed audio file; and provide results of the comparative scoring of the mixed files to each of the user and the additional user.

4. The system of claim 1, wherein the control system is connected with a first wearable audio device worn by the user and a second wearable audio device worn by the additional user, and the control system is further configured to send the respectively received user generated acoustic signals to the first wearable audio device and the second audio device for feedback to the respective users while operating in the multi-user performance mode in less than approximately 50 milliseconds after receipt.

5. The system of claim 1, wherein the musical performance guidance comprises sheet music for an instrument, adapted sheet music for the instrument, or voice-related musical descriptive language for a vocal performance.

6. The system of claim 1, wherein the control system is further configured to record the user generated acoustic signal with the audio playback of the audio performance file for subsequent playback.

7. The system of claim 1, wherein the speaker system is contained in a soundbar, wherein the soundbar is directly physically coupled with the display device or wirelessly connected with the display device.

8. The system of claim 1, wherein the control system at each of the speaker system and the geographically separated speaker system comprises a computational component and a scoring engine coupled with the computational component, and wherein comparing the respective user generated acoustic signals with each other or with the reference acoustic signal comprises:

processing the user generated acoustic signal at the respective computational component;

generating a pitch value for the processed user generated acoustic signal;

determining whether the generated pitch value deviates from a stored pitch value for the reference acoustic signal; and providing data to the other control system at the other speaker system indicating a determined deviation between the generated pitch value and the stored pitch value, wherein each control system is configured to provide the relative scores based on the determined deviations between the generated pitch value and the stored pitch value.

9. The system of claim 7, wherein the at least one far-field microphone is configured to pick up audio from locations that are at least one meter from the at least one far-field microphone, wherein the display device comprises a display screen having a corner-to-corner dimension greater than approximately 50 centimeters.

10. A method of controlling a system including two geographically separated speaker systems, wherein each speaker system is contained in a soundbar, has at least one far field microphone, and is coupled with a display device that is distinct from the speaker system, the method comprising:

receiving a first user command at a first speaker system and a second user command at a second speaker system to initiate a multi-user audio performance mode;

initiating audio playback of an audio performance file at a transducer at each of the first speaker system and the second speaker system;

initiating video playback including musical performance guidance associated with the audio performance file at each display device coupled with a corresponding soundbar;

receiving a first user generated acoustic signal at the at least one far field microphone at the first speaker system and receiving a second user generated acoustic signal at the at least one far field microphone at the second speaker system, after initiating the audio playback and the video playback;

comparing the first user generated acoustic signal and the second user generated acoustic signal with a reference acoustic signal to generate a first user score and a second user score, wherein comparing the first user generated acoustic signal and the second user generated acoustic signal with the reference acoustic signal includes performing time alignment of each of the first user generated acoustic signal and the second user generated acoustic signal with the reference signal and comparing a pitch in one or more segments of each of the first user generated acoustic signal and the second user generated acoustic signal with a pitch of a corresponding one or more segments in the reference acoustic signal; and providing feedback about the comparison including relative scores of the first user and the second user to both users.

11. The method of claim 10, further comprising:

recording the first user generated acoustic signal in a first file and recording the second user generated acoustic signal in a second file, mixing the first file and the second file with subsequently received audio signals from the first speaker system or the second speaker system to generate a first mixed file and a second mixed file, comparatively scoring the first mixed file and the second mixed file against a reference mixed file, and providing results of the comparative scoring to each of the first user and the second user.

12. The method of claim 10, further comprising:

sending the first user generated acoustic signal to a first wearable audio device worn by the first user while operating in the multi-user audio performance mode in less than approximately 50 milliseconds after receipt, and sending the second user generated acoustic signal to a second wearable audio device worn by the second user while operating in the multi-user audio performance mode in less than approximately 50 milliseconds after receipt.

13. The method of claim 10, wherein the musical performance guidance comprises sheet music for an instrument, adapted sheet music for the instrument, or voice-related musical descriptive language for a vocal performance.

14. The method of claim 10, further comprising recording the first user generated acoustic signal with the audio playback of the audio performance file for subsequent playback, and recording the second user generated acoustic signal with the audio playback of the audio performance file for subsequent playback.

15. A soundbar comprising:

an acoustic transducer;

a set of microphones comprising at least one far field microphone configured to pick up audio from locations that are at least one meter from the at least one far-field microphone;

a communications module for communicating with a display device that is physically distinct from the speaker system, wherein the display device comprises a display screen having a corner-to-corner dimension greater than approximately 100 centimeters with an intended viewing distance of at least three feet; and a control system coupled with the acoustic transducer, the set of microphones and the communications module, the control system configured to:

receive a user command to initiate an audio performance mode;

initiate audio playback of an audio performance file at the transducer;

initiate video playback comprising musical performance guidance associated with the audio performance file at the display device;

receive a user generated acoustic signal at the at least one far field microphone after initiating the audio playback and the video playback;

compare the user generated acoustic signal with a reference audio signal; and provide feedback about the comparison to the user within approximately 50 milliseconds after receipt of the user generated acoustic signals.

16. The soundbar of claim 15, wherein the control system is configured to operate in a multi-user audio performance mode with at least one additional soundbar in a distinct geographic location.

* * * * *